US006418647B1

(12) United States Patent
Erickson

(10) Patent No.: US 6,418,647 B1
(45) Date of Patent: Jul. 16, 2002

(54) FEEDING DEVICE FOR A DITCH DIGGING AND CLEANING SYSTEM

(76) Inventor: Edwin A. Erickson, 13946--86th St. SE., Milnor, ND (US) 58060-9750

( * ) Notice: Subject to any disclaimer, the term of this patent is extended or adjusted under 35 U.S.C. 154(b) by 0 days.

(21) Appl. No.: 09/638,234

(22) Filed: Aug. 14, 2000

Related U.S. Application Data

(63) Continuation-in-part of application No. 09/315,743, filed on May 20, 1999, now Pat. No. 6,226,903, and a continuation-in-part of application No. 09/638,323, filed on Aug. 14, 2000, now Pat. No. 6,341,435.

(51) Int. Cl.[7] ..... E02D 12/13
(52) U.S. Cl. ..... 37/366; 172/149
(58) Field of Search ..... D15/21; 37/366, 37/367, 380, 381; 172/284, 817, 823, 149

(56) References Cited

U.S. PATENT DOCUMENTS

| | | | | | |
|---|---|---|---|---|---|
| 163,061 | A | * | 5/1875 | Fenley | 172/75 |
| 2,027,502 | A | * | 1/1936 | Weismüller | 111/200 |
| 2,362,728 | A | * | 11/1944 | Smith | 172/195 |
| 2,455,148 | A | * | 11/1948 | Traver | 172/68 |
| 2,837,989 | A | * | 6/1958 | Gann | 172/64 |
| 3,483,929 | A | * | 12/1969 | MacIntyre et al. | 172/63 |
| 3,695,716 | A | * | 10/1972 | Meyer | 299/25 |
| 3,720,299 | A | * | 3/1973 | Wegmann et al. | 198/307.1 |
| 4,227,579 | A | * | 10/1980 | Isbell | 172/64 |
| 4,483,084 | A | * | 11/1984 | Caldwell et al. | 37/86 |
| 4,776,290 | A | * | 10/1988 | Rau et al. | 111/59 |
| 4,833,797 | A | * | 5/1989 | Slunecka et al. | 37/352 |
| 5,063,999 | A | * | 11/1991 | Packham | 172/1 |
| 5,113,610 | A | * | 5/1992 | Liebrecht, Jr. | 37/94 |
| 5,255,454 | A | * | 10/1993 | Pounds | 37/94 |

* cited by examiner

*Primary Examiner*—Robert E. Pezzuto
*Assistant Examiner*—Árpád F. Kovács
(74) *Attorney, Agent, or Firm*—Michael S. Neustel

(57) ABSTRACT

A feeding device for a ditch digging and cleaning system for allowing soil to be easily fed into one or more rotating dispersing members. The device includes a beater member positioned in the front portion of a frame having a hitch and a pair of support arms with wheels, a front blade, a pair of side blades, a dispersing member rotatably attached to the frame behind the front blade and the beater member, a power train mechanically connected to the dispersing member, and an adjustable deflector assembly attached to the rear portion of the frame. The dispersing member is comprised of a circular base, and a plurality of fan blades orthogonally attached to an upper surface of the circular base. The dispersing member is juxtaposed behind a pan attached to the front blade. The dispersing member is also less than 45 degrees with respect to the ground surface. The blade preferably is V-shaped for penetrating hardened soil. The beater member is comprised of a shaft member, a plurality of center paddle members attached to the shaft member, a plurality of side paddle members, a drive system mechanically connected to the shaft member, and a drive motor mechanically connected to the drive system. In operation, the front blade severs the dirt from the ground surface at a desired depth thereby simultaneously elevating the soil a finite distance after which the beater member engages the elevated soil thereby breaking the elevated soil apart and forcing the soil downwardly into the dispersing member where after the fan blades throw the dirt in a desired location.

20 Claims, 6 Drawing Sheets

FEEDING DEVICE FOR A DITCH DIGGING AND CLEANING SYSTEM

CROSS-REFERENCE TO A RELATED PATENT APPLICATION

This is a continuation-in-part application for U.S. pat. application Ser. No. 09/315,743 filed on May 20, 1999 issued into U.S. Pat. No. 6,226,903, and U.S. patent application Ser. No. 09/638,323 filed on Aug. 14, 2000 issued into U.S. Pat. No. 6,341,435.

BACKGROUND OF THE INVENTION

1. Field of the Invention

The present invention relates generally to ditch diggers and more specifically it relates to a feeding device for a ditch digging and cleaning system for allowing soil to be easily fed into one or more rotating dispersing members.

Farmers often times desire to dig ditches for draining water from fields thereby increasing the usability of the land. In addition, farmers often times desire to construct terraces on uneven land. Hence, it is desirable to have a single machine that both digs ditches and creates terraces.

The invention described in U.S. pat. application Ser. No. 09/315,743 provides such a machine that includes a front blade and an inclined dispersing member that receives severed soil from the front blade. One of the problems associated a structure as disclosed within the patent application is that the soil becomes elevated from the front blade and does not always drop down onto the rotating dispersing member thereby causing plugging problems and soil dispersing problems. Hence, there is a need for a structure that improves the feeding of the soil material into the dispersing member to ensure that the soil material is properly received by the dispersing member during operation of the ditch digging and cleaning system 2. Description of the Prior Art Ditch digging devices have been in use for years. Typically, a vertically orientated rotary blade member is utilized that has a rotational plane parallel to a vertical axis. The lower edge of a rotary blade engages, cuts and throws the dirt creating a curved ditch structure.

Conventional ditch diggers require significant PTO power to the PTO shaft since the rotary blade is initially engaging, cutting and throwing the dirt. In addition, conventional ditch diggers merely cutout a curved ditch that easily fills in with dirt and debris over time requiring constant cleaning. Also, a curved ditch is incapable of handling as large of volume of water as a flat-bottomed ditch of the same width. In additional, the velocity of water flowing through a conventional curved ditch is significantly higher than a flat-bottomed ditch of the same width thereby increasing erosion of the land.

The invention described in U.S. pat. application Ser. No. 09/315,743 solves most of these problems associated with conventional ditch diggers. However, one of the problems associated with the structure as disclosed within the patent application is that the soil becomes elevated from the front blade and does not always drop down onto the rotating dispersing member thereby causing plugging problems and soil dispersing problems.

Examples of patented ditch diggers include U.S. Pat. No. 5,113,610 to Liebrecht, Jr.; U.S. Pat. No. 2,965,985 to Sillasen; U.S. Pat. No. 5,237,761 to Nadeau; U.S. Pat. No. 3,624,826 to Rogers; U.S. Pat. No. 3,025,618 to Croucher; U.S. Pat. No. 2,923,073 to Baker; U.S. Pat. No. 2,885,800 to Hawkins; U.S. Pat. No. 1,175,926 to Bunnell; U.S. Pat. No. 1,095,097 to Fournet; U.S. Pat. No. 5,027,534 to Sackett; U.S. Pat. No. 16,007 to Evans which are all illustrative of such prior art.

Liebrecht, Jr. (U.S. Pat. No. 5,113,610) discloses a rotating disk type ditcher. Liebrecht teaches a frame structure, a PTO power system, and a cutting disk inclined downwardly so that the leading edge cuts into the ground. A plurality of paddles or scoops are positioned on the back side of the disk that throw the soil particles.

Sillasen (U.S. Pat. No. 2,965,985) discloses a rotary whirling ditcher. Sillasen teaches a frame, a drive assembly, and a plurality of rotating blades.

Nadeau (U.S. Pat. No. 5,237,761) discloses a rotary ditcher having ripper blades. Nadeau teaches a flywheel type rotor carrying impeller blades that pickup and throw soil to the side of the rotor, and two ripper blades in front of the rotor that loosen the soil.

While these devices may be suitable for the particular purpose to which they address, they are not as suitable for easily digging ditches, cleaning ditches, and creating terraces with reduced power take-off (PTO) power. Conventional machines require extensive PTO power for operating properly which can be extremely demanding upon a tractor vehicle.

In these respects, the feeding device for a ditch digging and cleaning system according to the present invention substantially departs from the conventional concepts and designs of the prior art, and in so doing provides an apparatus primarily developed for the purpose of allowing soil to be easily fed into one or more rotating dispersing members that are orientated at an angle with respect to a ground surface.

SUMMARY OF THE INVENTION

In view of the foregoing disadvantages inherent in the known types of ditch diggers now present in the prior art, the present invention provides a new feeding device for a ditch digging and cleaning system construction wherein the same can be utilized for allowing soil to be easily fed into one or more rotating dispersing members.

The general purpose of the present invention, which will be described subsequently in greater detail, is to provide a new feeding device for a ditch digging and cleaning system that has many of the advantages of the ditch diggers mentioned heretofore and many novel features that result in a new feeding device for a ditch digging and cleaning system which is not anticipated, rendered obvious, suggested, or even implied by any of the prior art ditch diggers, either alone or in any combination thereof.

To attain this, the present invention generally comprises a beater member positioned in the front portion of a frame having a hitch and a pair of support arms with wheels, a front blade, a pair of side blades, a dispersing member rotatably attached to the frame behind the front blade and the beater member, a power train mechanically connected to the dispersing member, and an adjustable deflector assembly attached to the rear portion of the frame. The dispersing member is comprised of a circular base, and a plurality of fan blades orthogonally attached to an upper surface of the circular base. The dispersing member is juxtaposed behind a pan attached to the front blade. The dispersing member is also less than 45 degrees with respect to the ground surface. The blade preferably is V-shaped for penetrating hardened soil. The beater member is comprised of a shaft member, a plurality of center paddle members attached to the shaft member, a plurality of side paddle members, a drive system mechanically connected to the shaft member, and a drive motor mechanically connected to the drive system. In operation, the front blade severs the dirt from the ground surface at a desired depth thereby simultaneously elevating the soil a finite distance after which the beater member engages the elevated soil thereby breaking the elevated soil apart and forcing the soil downwardly into the dispersing member where after the fan blades throw the dirt in a desired location.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a feeding device for a ditch digging and cleaning system that will overcome the shortcomings of the prior art devices.

Another object is to provide a feeding device for a ditch digging and cleaning system that requires significantly less PTO power than conventional ditch digging devices.

An additional object is to provide a feeding device for a ditch digging and cleaning system that can be utilized to dig ditches, clean ditches or create terraces within a field.

A further object is to provide a feeding device for a ditch digging and cleaning system that creates a flat bottomed ditch thereby reducing the velocity of water flow.

Another object is to provide a feeding device for a ditch digging and cleaning system that can be connected to most tractors.

A further object is to provide a feeding device for a ditch digging and cleaning system that allows soil to be easily fed into one or more rotating dispersing members.

An additional object is to provide a feeding device for a ditch digging and cleaning system that breaks up soil material prior to entering a dispersing member.

Another object is to provide a feeding device for a ditch digging and cleaning system that directs compressed soil material downwardly upon one or more dispersing members.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
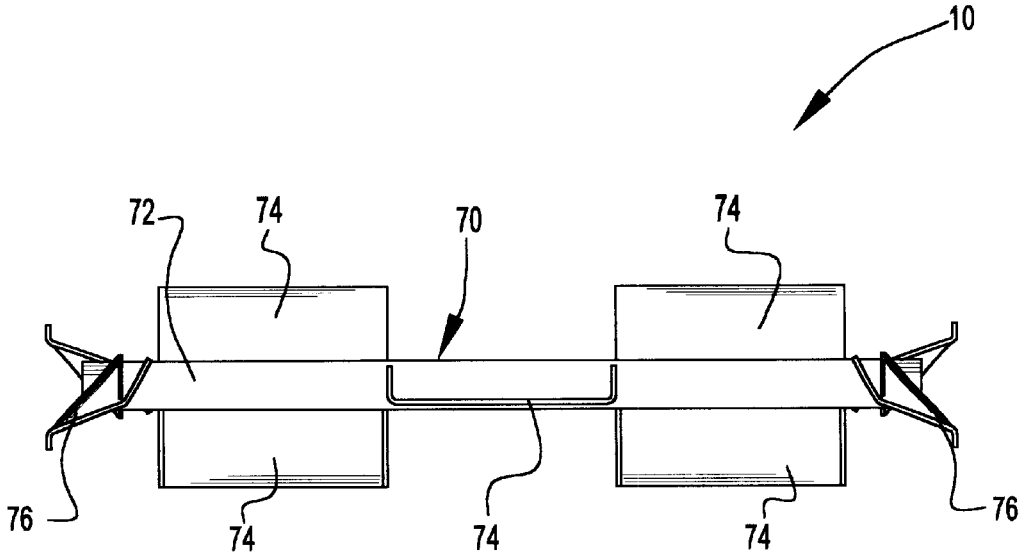
FIG. 1 is a front view of the present invention which is attached to the ditch digging and cleaning system.

Turning now descriptively to the drawings, in which similar reference characters denote similar elements throughout the several view, FIGS. 1 through 4 illustrate a feeding device for a ditch digging and cleaning system 10. The ditch digging and cleaning system as described within a prior filed patent application generally comprises a beater member 70 positioned in the front portion of a frame 20 having a hitch and a pair of support arms with wheels, a front blade 40, a pair of side blades, a dispersing member 30 rotatably attached to the frame 20 behind the front blade 40 and the beater member 70, a power train mechanically connected to the dispersing member 30, and an adjustable deflector assembly attached to the rear portion of the frame 20. The dispersing member 30 is comprised of a circular base, and a plurality of fan blades 34 orthogonally attached to an upper surface of the circular base. The dispersing member 30 is juxtaposed behind a pan attached to the front blade 40. The dispersing member 30 is also less than 45 degrees with respect to the ground surface. The blade preferably is V-shaped for penetrating hardened soil. The beater member 70 is comprised of a shaft member 72, a plurality of center paddle members 74 attached to the shaft member 72, a plurality of side paddle members 76, a drive system mechanically connected to the shaft member 72, and a drive motor mechanically connected to the drive system. In operation, the front blade 40 severs the dirt from the ground surface at a desired depth thereby simultaneously elevating the soil a finite distance after which the beater member 70 engages the elevated soil thereby breaking the elevated soil apart and forcing the soil downwardly into the dispersing member 30 where after the fan blades throw the dirt in a desired location.

Figure 3:
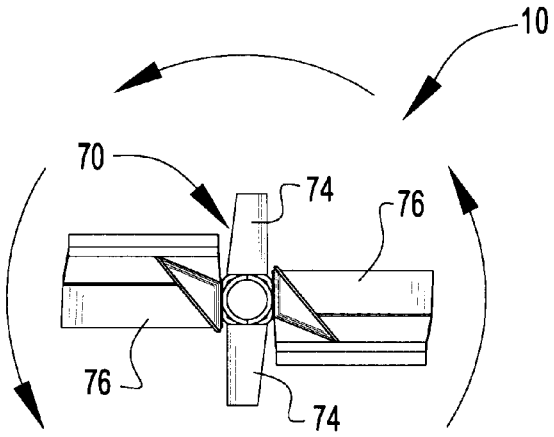
FIG. 3 is a side view of the present invention showing the rotational movement of the present invention.
Figure 4:
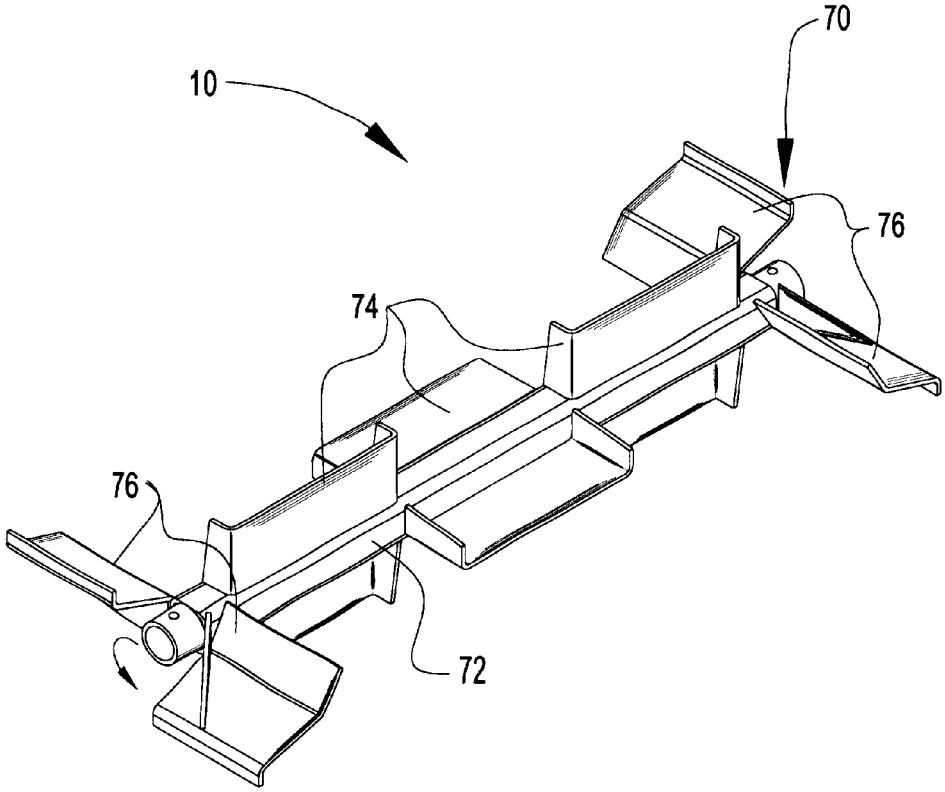
FIG. 4 is an upper perspective view of the present invention.
Figure 5:
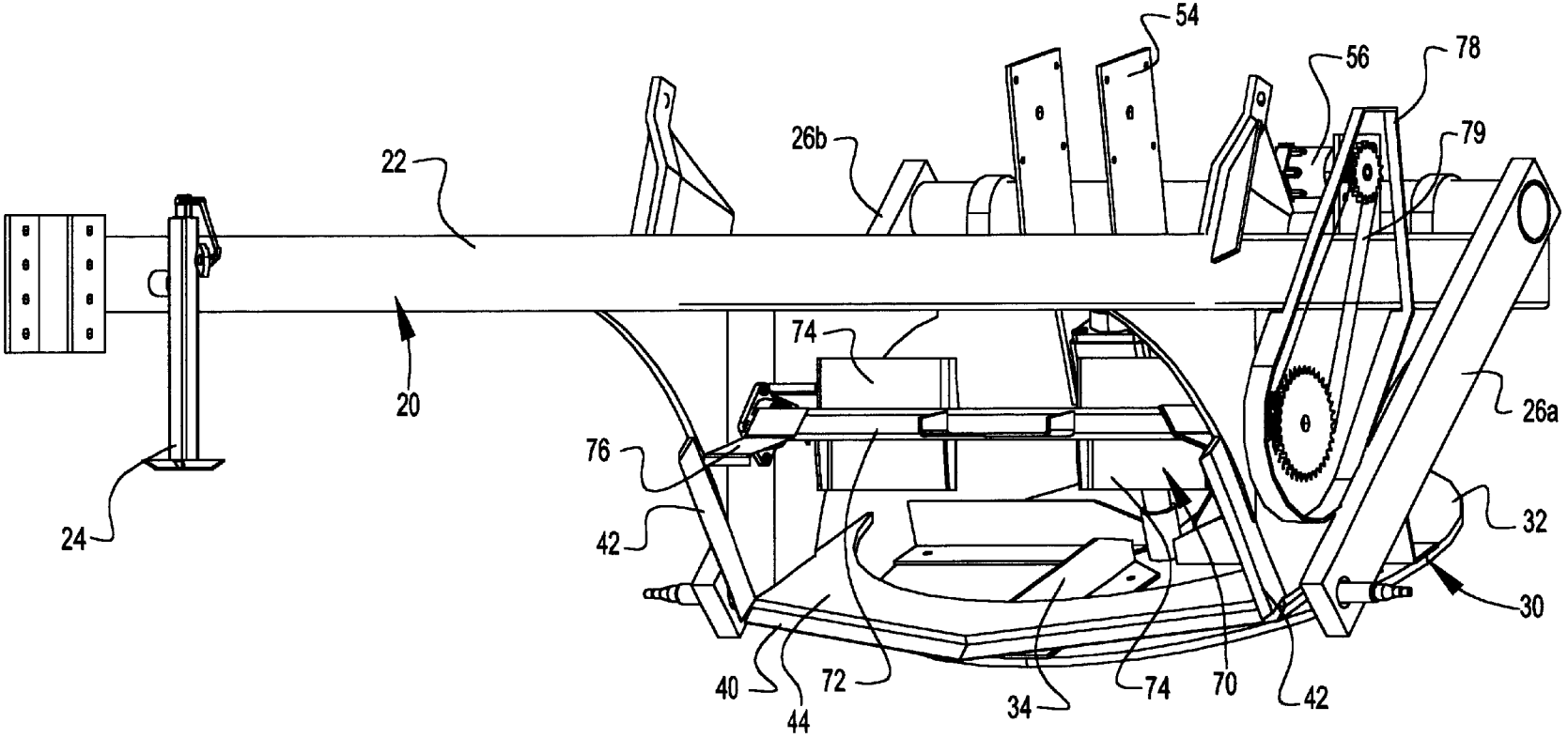
FIG. 5 is an upper perspective view of the present invention rotatably attached within the ditch digging and cleaning system.
Figure 6:
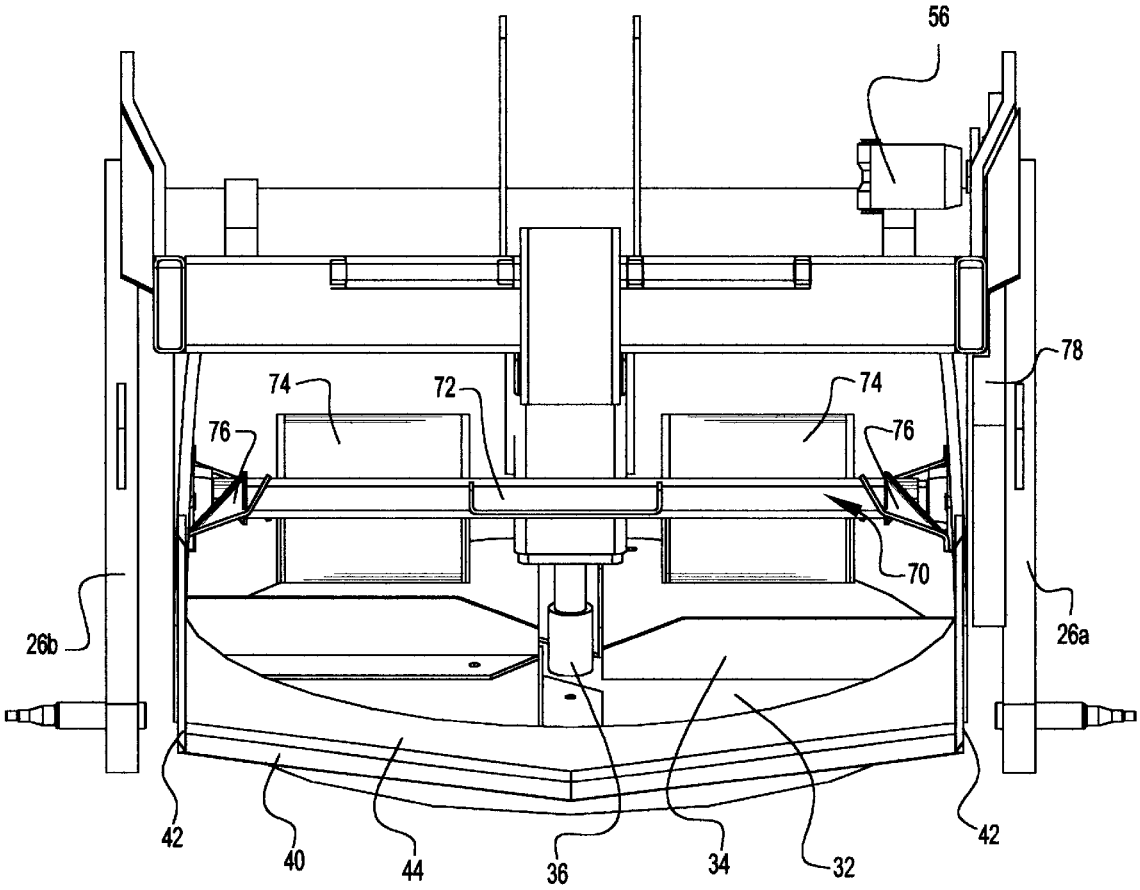
FIG. 6 is a front view of the present invention rotatably attached within the ditch digging and cleaning system.
Figure 7:
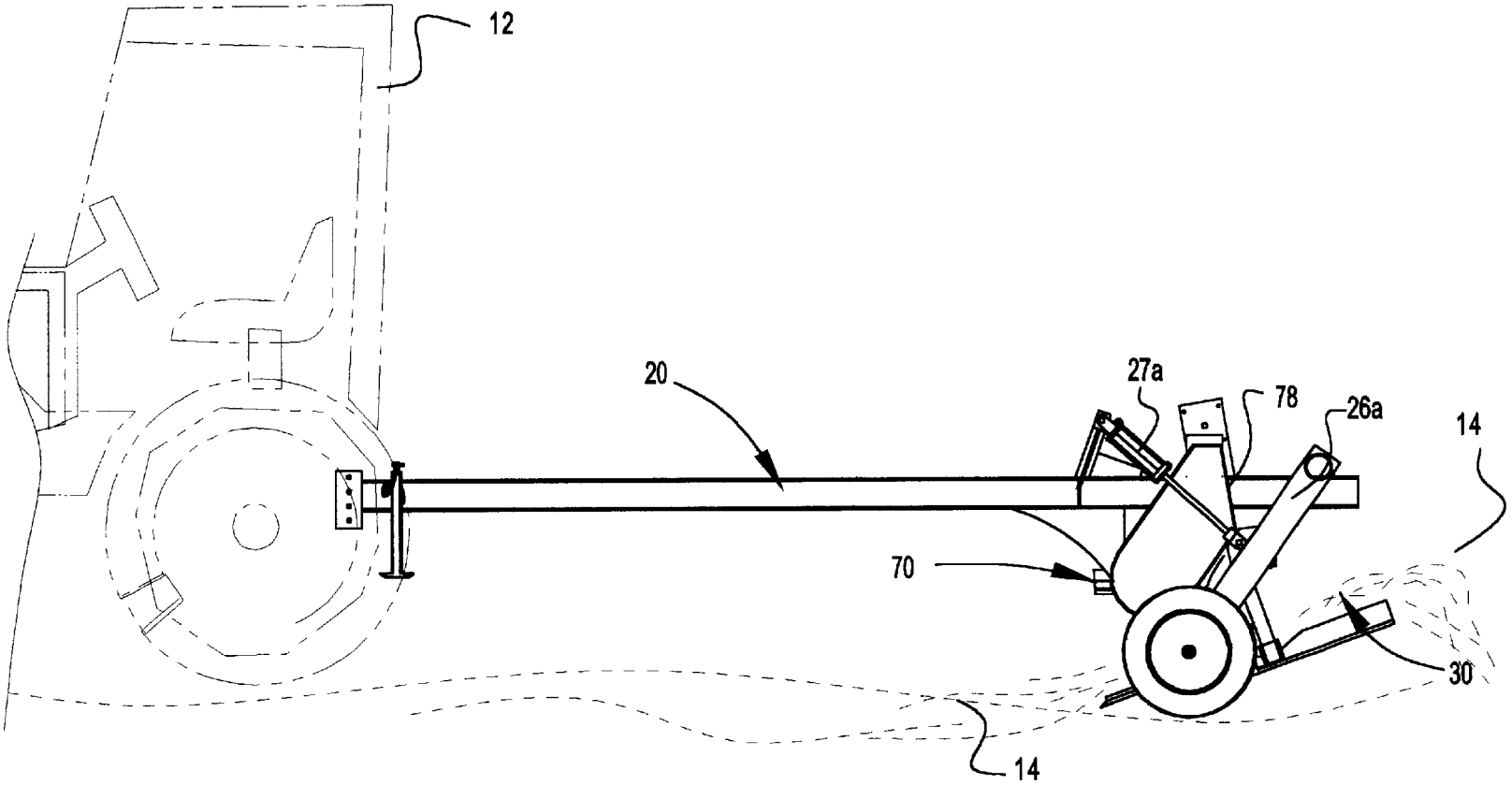
FIG. 7 is:a side view of the present invention rotatably attached within the ditch digging and cleaning system.
Figure 8:
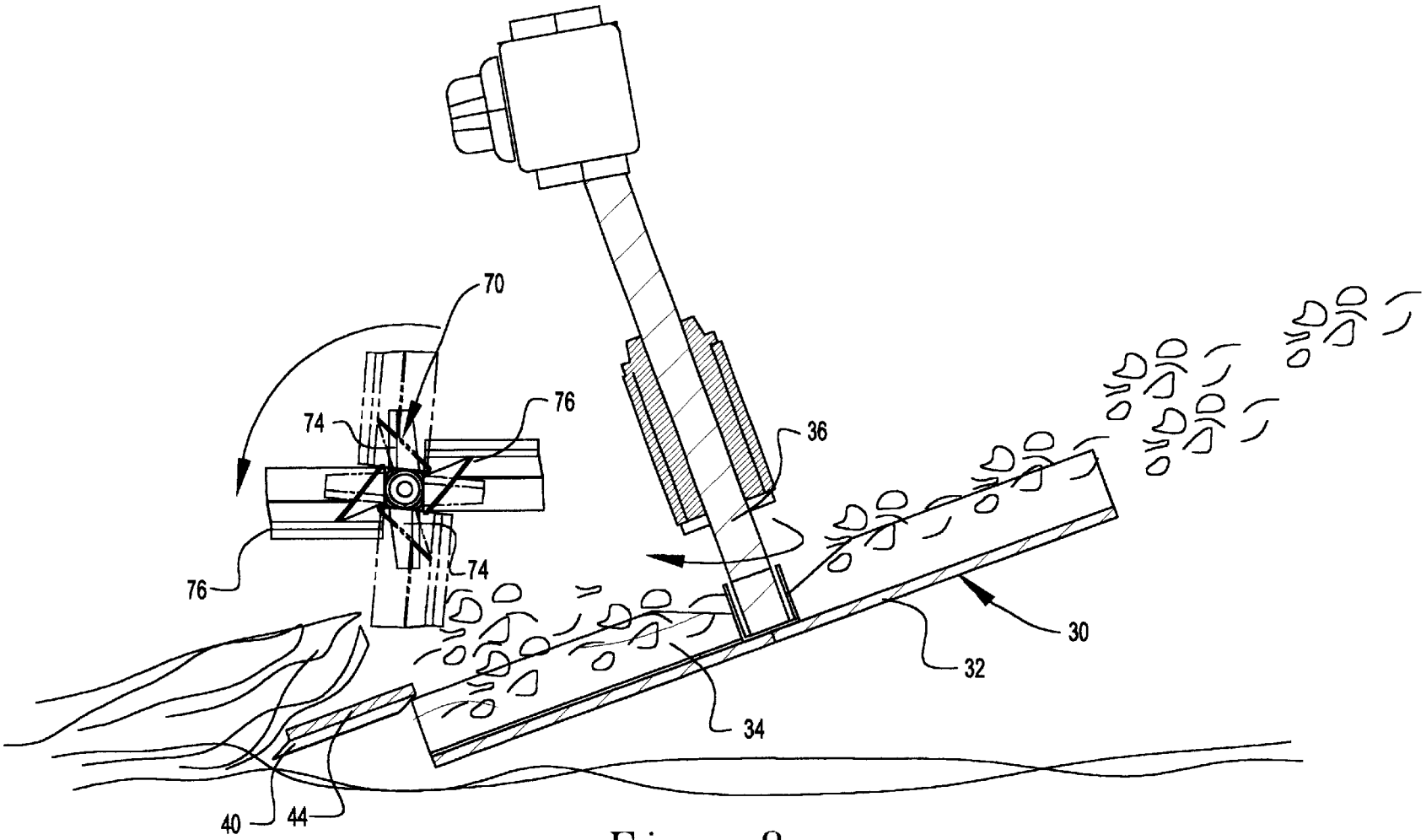
FIG. 8 is a magnified cutaway side view of the present invention engaging the soil material elevated from the front blade thereby breaking up the soil material and pushing the soil material downwardly into the dispersing member.

As best shown in FIGS. 1, 3 and 4 of the drawings, the frame 20 includes a hitch 22 for connecting to a tractor vehicle. A jack 24 is attached to the front portion of the hitch 22 for supporting the hitch 22 when not attached to a tractor.

A pair of support arms 26*a–b* are pivotally attached to the rear portion of the frame 20 as shown in FIGS. 1 and 3 of the drawings. The support arms 26*a–b* are preferably angled forwardly as best shown in FIG. 3 of the drawings. A pair of wheels 28 are rotatably attached to the distal ends of the support arms 26*a–b* as shown in FIGS. 1, 3 and 4 of the drawings. A pair of hydraulic cylinders 27*a–b* are connected between the frame 20 and the support arms 26*a–b* for elevating and lowering the frame 20 as best shown in FIG. 3 of the drawings. The hydraulic cylinders 27*a–b* control the depth of the front blade 40. As best shown in FIG. 4 of the drawings, the. wheels 28 are positioned outside of the front blade 40 thereby ensuring an even cut through the ground surface.

Figure 2:
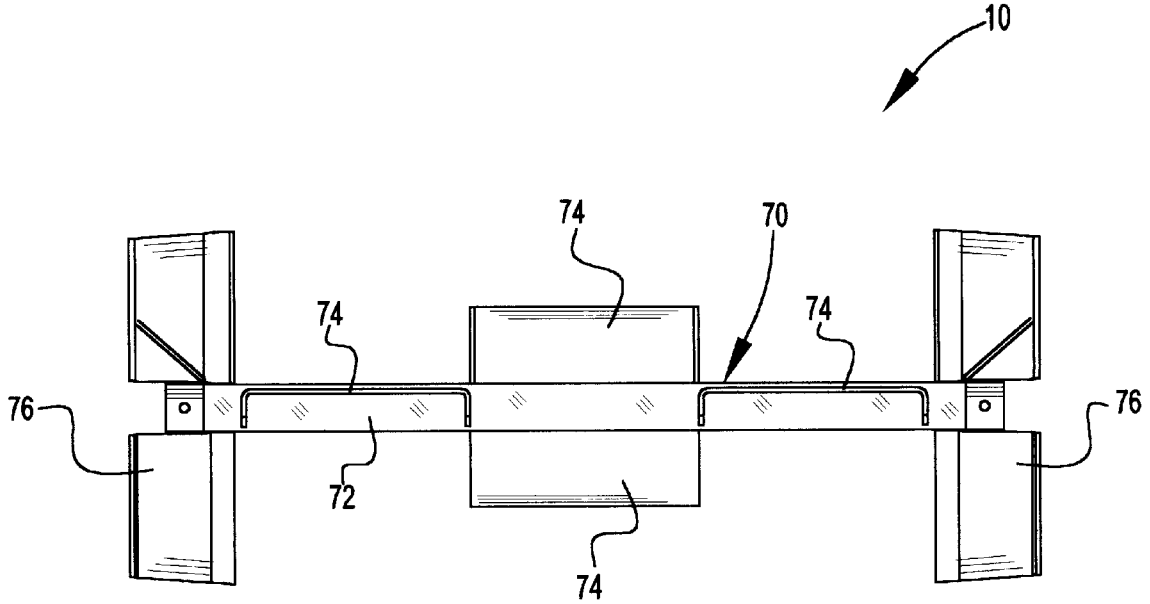
FIG. 2 is a front view of the present invention rotated 90 degrees.

As best shown in FIG. 2 of the drawings, a front blade 40 is attached to the frame 20 along with a pair of side blades 42. The front blade 40 preferably has a V-shape for providing easy penetration into a hardened ground. The front blade 40 is preferably removable and replaceable by another front blade 40 during extend periods of use. The pair of side blades 42 are substantially vertically orientated along the sides of the front blade 40 as shown in FIG. 2 of the drawings. A pan 44 is attached behind the front blade 40 for channeling the newly cut dirt rearwardly. The pan 44 has a semi-circular cutout that receives the dispersing member 30 as best shown in FIG. 1 of the drawings.

A power train is attached to the frame 20. The power train may comprise a PTO shaft, a gear box, and a drive shaft. The PTO shaft is rotatably attached to the frame 20 and is connectable at one end to the PTO of a conventional tractor. The gear box is attached to the opposing end of the PTO shaft for converting the rotational speed downward. The drive shaft is connected to the gear box and to the dispersing member.

As best shown in FIG. 4 of the drawings, the dispersing member 30 is generally circular in shape. It can be appreciated that more than one dispersing member 30 may be utilized within the ditch digging and cleaning system shown in the figures such as having a pair of the dispersing members 30 side-by-side. The dispersing member 30 comprises a flat base 32 and a plurality of fan bladed attached to an upper surface of the base 32. The base 32 is circular and has an edge juxtaposed to the semi-circular cutout within the pan 44. The base 32 is lower than the upper surface of the pan 44 thereby allowing the dirt to drop onto the base 32. As best shown in FIG. 3 of the drawings, the base 32 is less than 45 degrees with respect to the ground surface when in operation thereby utilizing little PTO power to elevate the dirt.

The fan blades 34 are preferably attached substantially orthogonally to the upper surface of the base 32. There are preferably four fan blades 34, however it can be appreciated by one skilled in the art than more or less fan blades 34 may be utilized. Some of the fan blades 34 are taller than the other fan blades 34 for providing increased engagement and throwing of the dirt dropped onto the base 32.

As shown in FIGS. 1, 3 and 4 of the drawings, the deflector assembly 60 is attached to the rear portion of the frame 20 for directing the thrown dirt from the dispersing member 30. The deflector assembly 60 is comprised of a pair of adjustable brackets 62*a–b*. A main deflector 64 is attached to the adjustable brackets 62*a–b* as best shown in FIG. 4 of the drawings. An outer deflector 66 is pivotally attached to the main deflector 64 as shown in FIG. 4. The outer deflector 66 includes a plurality of apertures 69 that adjustably receive a locking bar 68 for allowing adjustment of the position of the outer deflector 66.

As best shown in FIGS. 5 through 8 of the drawings, a beater member 70 is rotatably attached to the frame 20 directly above the front blade 40. A drive motor 56 is attached to the frame 20 and is mechanically connected to the beater member 70 through a drive system 78 which may utilize a drive chain 79 or other connection means. The drive motor 56 may be comprised of a conventional electric or hydraulic motor as can be appreciated by one skilled in the art.

As best shown in FIGS. 1 through 4 of the drawings, the beater member 70 is comprised of a plurality of paddle members 74, 76 that are utilized to push the newly cut dirt downwardly onto the dispersing member 30 as the dirt leaves the pan 44. More specifically, a plurality of center paddle members 74 are attached to a shaft member 72 of the beater member 70 wherein the center paddle members 74 engage a center portion of the soil cut by the front blade 40.

The center paddle members 74 are preferably staggered with respect to adjacent center paddle members 74 as is best shown in FIG. 4 of the drawings. The center paddle members 74 preferably have a U-shaped cross sectional area thereby providing increased support during operation of the invention. As further shown in FIG. 4 of the drawings, the center paddle members 74 preferably are secured on opposing sides of the shaft member 72 at approximately 180 degrees with respect to one another. FIG. 4 shows the usage of three rows of center paddle members 74, however it can be appreciated that various other designs and number of rows may be utilized to accomplish the present invention.

As further shown in FIGS. 1 through 4 of the drawings, a plurality of side paddle members 76 are attached to the end portions of the shaft member 72 of the beater member 70. The side paddle members 76 preferably are angled to divert the side portions of the soil cut with the front blade 40 and the side blades 42 toward the center portion of the invention thereby reducing buildup of soil and debris near the side blades 42. As further shown in FIG. 4 of the drawings, the side paddle members 76 are preferably positioned substantially orthogonally with respect to the center paddle members 74.

In use, the user adjusts the hydraulic cylinders 27*a–b* depending upon the depth desired to cut into the ground surface. The user then engages the PTO or hydraulic system thereby causing the dispersing member 30 to rotate behind the front blade 40. The user then operates the conventional tractor pulling the invention forwardly so that the front blade 40 penetrates the ground surface. The newly cut dirt flows upon the pan 44 toward the dispersing member 30 where the beater member 70 engages the dirt breaking the dirt apart and pushing downwardly upon the dispersing member 30. The dirt falls onto the base 32 where after the fan blades 34 engage the dirt. The fan blades 34 throw the dirt outwardly to the side and rearwardly where the deflector assembly 60 deflects a portion of the thrown dirt into the desired direction. The user may pass over the newly created channel if they desire to dig a deeper channel. If the user desires to create a terrace, the user simply continues passing over the field throwing the dirt in the desired location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A feeding device in combination with a ditch digging and cleaning system having a frame, a front blade attached to said frame having an angle with respect to a ground surface of less than 45 degrees for severing and upwardly lifting a portion of ground, a dispersing member rotatably driven upon said frame and having a rotational plane substantially parallel to said front blade, wherein said feeding device comprises:

a shaft member rotatably attached to said frame;

a means for rotating said shaft member; and a plurality of paddle members extending radially from said shaft member for engaging soil cut and lifted by said front blade.

2. The feeding device for a ditch digging and cleaning system of claim 1, wherein said means for rotating said shaft member comprises a motor.

3. The feeding device for a ditch digging and cleaning system of claim 2, wherein said motor is comprised of a hydraulic motor.

4. The feeding device for a ditch digging and cleaning system of claim 2, wherein said motor is comprised of an electric motor.

5. The feeding device for a ditch digging and cleaning system of claim 1, wherein said means for rotating said shaft member comprises a drive train mechanically connected to a PTO system of a tractor.

6. The feeding device for a ditch digging and cleaning system of claim 1, wherein each of said plurality of paddle members has a U-shaped cross sectional area.

7. The feeding device for a ditch digging and cleaning system of claim 1, wherein said plurality of paddle members comprises a plurality of center paddle members positioned between opposing ends of said shaft member.

8. The feeding device for a ditch digging and cleaning system of claim 7, wherein said plurality of paddle members further includes a plurality of side paddle members attached to said opposing ends of said shaft member.

9. The feeding device for a ditch digging and cleaning system of claim 8, wherein each of said center paddle members is comprised of a U-shaped cross sectional area.

10. The feeding device for a ditch digging and cleaning system of claim 8, wherein said side paddle members are angled to direct said soil inwardly.

11. The feeding device for a ditch digging and cleaning system of claim 7, wherein said plurality of center paddle members are comprised of at least two radially orientated rows.

12. The feeding device for a ditch digging and cleaning system of claim 11, wherein said plurality of center paddle members are staggered with respect to adjacent radially orientated rows.

13. The feeding device for a ditch digging and cleaning system of claim 12, wherein each of said radially orientated rows is comprised of two opposing center paddle members.

14. The feeding device for a ditch digging and cleaning system of claim 13, wherein said center paddle members of each said radially orientated rows are 180 degrees with respect to one another.

15. The feeding device for a ditch digging and cleaning system of claim 1, wherein an axis of said shaft member is positioned behind a vertically orientated plane that intersects a front edge of said front blade.

16. The feeding device for a ditch digging and cleaning system of claim 15, wherein plurality of paddle members urge said soil downwardly into said dispersing member.

17. The feeding device for a ditch digging and cleaning system of claim 16, wherein a rotational velocity of said shaft member directly corresponds to a horizontal velocity of said ditch digging and cleaning system.

18. A ditch digging and cleaning system comprising:

a frame;

a front blade attached to said frame, wherein said front blade has an angle with respect to a ground surface of less than 45 degrees for severing and upwardly lifting a portion of ground;

a dispersing member rotatably driven upon said frame behind said front blade;

a feeding device comprising:

a shaft member rotatably attached to said frame;

a means for rotating said shaft member; and a plurality of paddle members extending from said shaft member for engaging soil cut and lifted by said front blade.

19. The feeding device for a ditch digging and cleaning system of claim 18, wherein each of said plurality of paddle members has a U-shaped cross sectional area.

20. The feeding device for a ditch digging and cleaning system of claim 18, wherein said plurality of paddle members comprises a plurality of center paddle members positioned between opposing ends of said shaft member.

* * * * *